United States Patent [19]

Fujiwara et al.

[11] Patent Number: 5,058,877

[45] Date of Patent: Oct. 22, 1991

[54] AUTOMATIC CUT-SHEET FEEDING APPARATUS

[75] Inventors: Hidehiko Fujiwara; Hideyo Watanabe, both of Yokohama; Hiroyuki Idenawa, Hiratsuka, all of Japan

[73] Assignee: Ricoh Company, Ltd., Tokyo, Japan

[21] Appl. No.: 525,750

[22] Filed: May 18, 1990

[30] Foreign Application Priority Data

May 19, 1989 [JP] Japan ..... 1-126155
Nov. 20, 1989 [JP] Japan ..... 1-301416

[51] Int. Cl.[5] ..... B65H 3/52
[52] U.S. Cl. ..... 271/124; 271/161
[58] Field of Search ..... 271/113, 121, 161, 124, 271/125, 19

[56] References Cited

U.S. PATENT DOCUMENTS 4,815,724 3/1989 Sumida et al. ..... 271/121

FOREIGN PATENT DOCUMENTS 113046 7/1983 Japan ..... 271/124
249841 10/1987 Japan ..... 271/121
295841 12/1987 Japan ..... 271/121
212637 9/1988 Japan ..... 271/121
104537 4/1989 Japan ..... 271/121
023125 1/1990 Japan ..... 271/121

*Primary Examiner*—H. Grant Skaggs
*Assistant Examiner*—Carol Lynn Druzbick
*Attorney, Agent, or Firm*—Cooper & Dunham

[57] ABSTRACT

An automatic cut-sheet feeding apparatus includes a feed roller which rotates in a direction so as to feed in and feed out an upper most cut-sheet, and means for stopping the feeding of excessive cut-sheets which should not be fed out together with the uppermost cut-sheet when a plurality of cut-sheets are fed in together by the feed roller, and thereby automatically feeding cut only the uppermost cut-sheet of the stack of cut-sheet one by one, the stopping means includes a holder pressed against said feed roller, a push-piece supported on the holder and pressed at a position preceding a position where the holder makes contact with said feed roller along a direction in which the cut-sheet is transported thus causing excessive cut-sheets to curve downwards when a plurality of cut-sheets pass between the feed roller and the push-piece, and a stop surface disposed to confront a leading edge of the curved excessive cut-sheet and engage the leading edge thereof.

9 Claims, 12 Drawing Sheets

50

AUTOMATIC CUT-SHEET FEEDING APPARATUS

BACKGROUND OF THE INVENTION

The present invention generally relates to automatic cut-sheet feeding apparatuses, and more particularly to an automatic cut-sheet feeding apparatus incorporated into an image forming apparatus such as a laser printer and the like.

In order to improve the reliability of the laser printer, the automatic cut-sheet feeding apparatus in this laser printer is required to positively feed out only the single uppermost cut-paper out of the stack of cut-sheets one by one irrespective of the kind of cut-sheet.

FIG. 1 shows the conventional automatic cut-sheet feeding apparatus 10.

A pad 11 is urged by a coil spring 12 so as to be pressed into contact with a peripheral surface of a feed roller 13 made of rubber at the bottom thereof, as shown in FIG. 2. A stack of cut-sheets 14 are placed on a cassette 15, and the uppermost cut-sheet 14-1 of the stack of cut-sheets 14 is pressed against the feed roller 13.

When the feed roller 13 is rotated in a direction A, the uppermost cut-sheet 14-1 is normally fed in a direction B and passes between the feed roller 13 and the pad 11.

In the case where the cut-sheets are a special kind so that an attraction force between two cut-sheets due to static electricity is relatively large, a cut-sheet 14-2 just below the cut-sheet 14-1 is fed together with the uppermost cut-paper 14-1 by the feed roller 13 as indicated in FIG. 3.

A portion 16 on the pad 11 just preceding a contact point 17 where the pad 11 comes into contact with the feed roller 13 functions to stop the leading end 14-2*a* of the cut-sheet 14-2, and thereby to restrict further feeding of the cut-sheet 14-2.

However, the feed stopping function of the portion 16 is not sufficient, and the cut-sheet 14-2 slips on the pad 11, and thus there may occur feeding such that two cut-sheets 14-1 and 14-2 are fed together one on top of the other, as shown in FIG. 4.

In order to prevent the occurrence of the aforementioned stacked-feeding as much as possible, the stack of cut-sheets 14 must be positioned so as to incline as much as 30° with respect to the plane of the upper surface of the pad 11.

However, this arrangement is apt to make feeding of the cut-sheet 14-1 abnormal, and thereby causing jamming of the cut-sheets to occur.

SUMMARY OF THE INVENTION

Accordingly, it is a general object of the present invention to provide a novel and useful automatic cut-sheet feeding apparatus in which the problems described heretofore are eliminated.

Another and more specific object of the present invention is to provide an automatic cut-sheet feeding apparatus, in which means for stopping the feeding of an excessive amount of cut-sheets which should not be fed is provided.

According to the present invention, even if the cut-paper is a special type, such as OHP, stacked-feeding can be prevented, and the inclination angle of the cassette with respect to the upper surface of the holder can be make small, which ensures smooth feeding of the cut-sheets.

Other objects and further features of the present invention will be apparent from the following detailed description when read in conjunction with the accompanying drawings.

PREFERRED DESCRIPTION OF THE EMBODIMENTS

Figure 1:
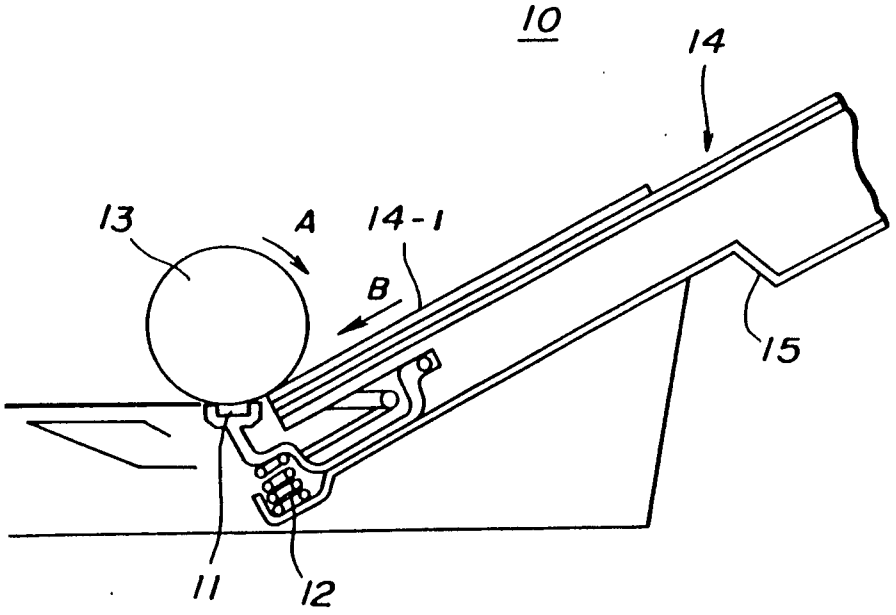
FIG. 1 PRIOR ART
FIG. 1 is a cross sectional view generally showing an example of the conventional automatic cut-sheet feeding apparatus.
Figure 2:
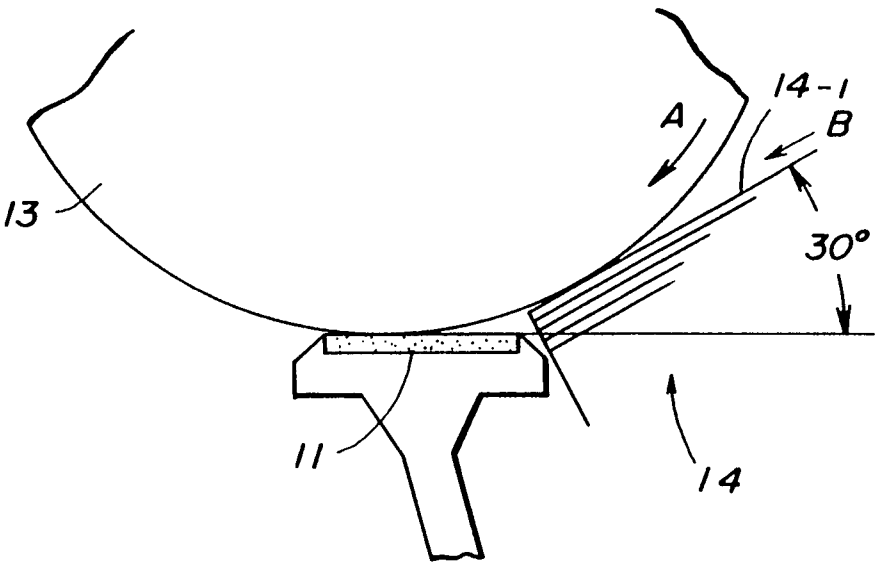
FIG. 2 PRIOR ART
FIG. 2 is an enlarged view of an essential part in FIG. 1.
Figure 3:
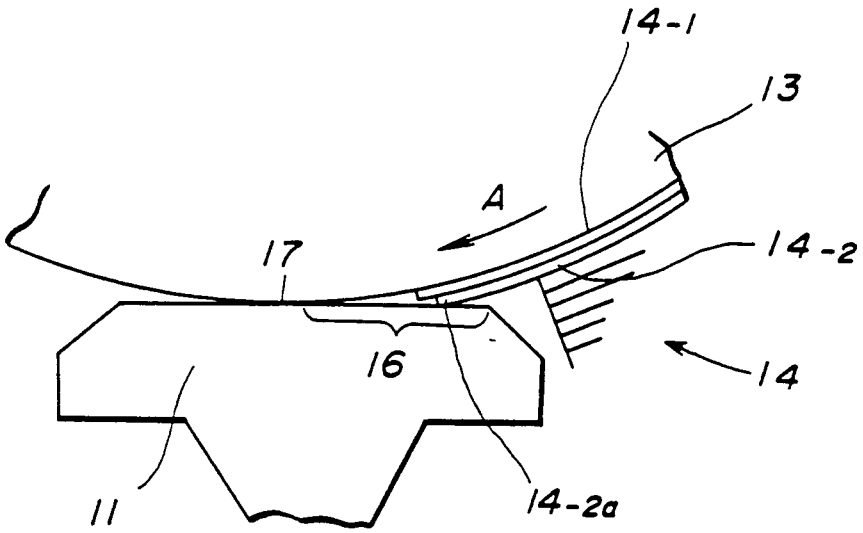
FIG. 3 PRIOR ART
FIGS. 3 and 4 are schematic views showing the operation of feeding cut-sheets in the apparatus shown in FIG. 1.
Figure 4:
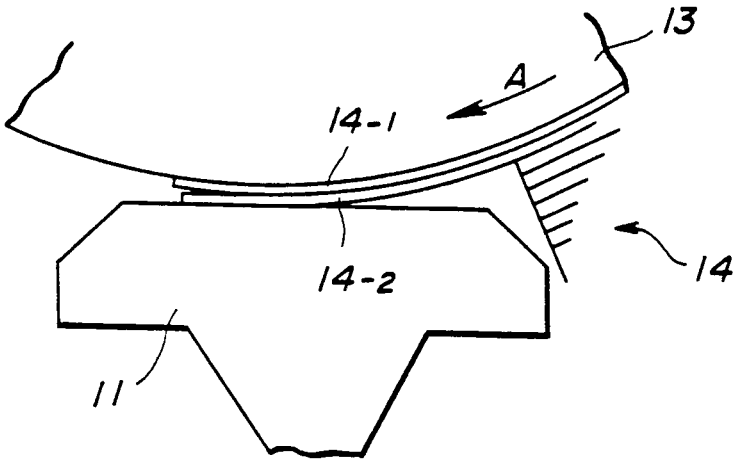
FIG. 4 PRIOR ART
Figure 5:
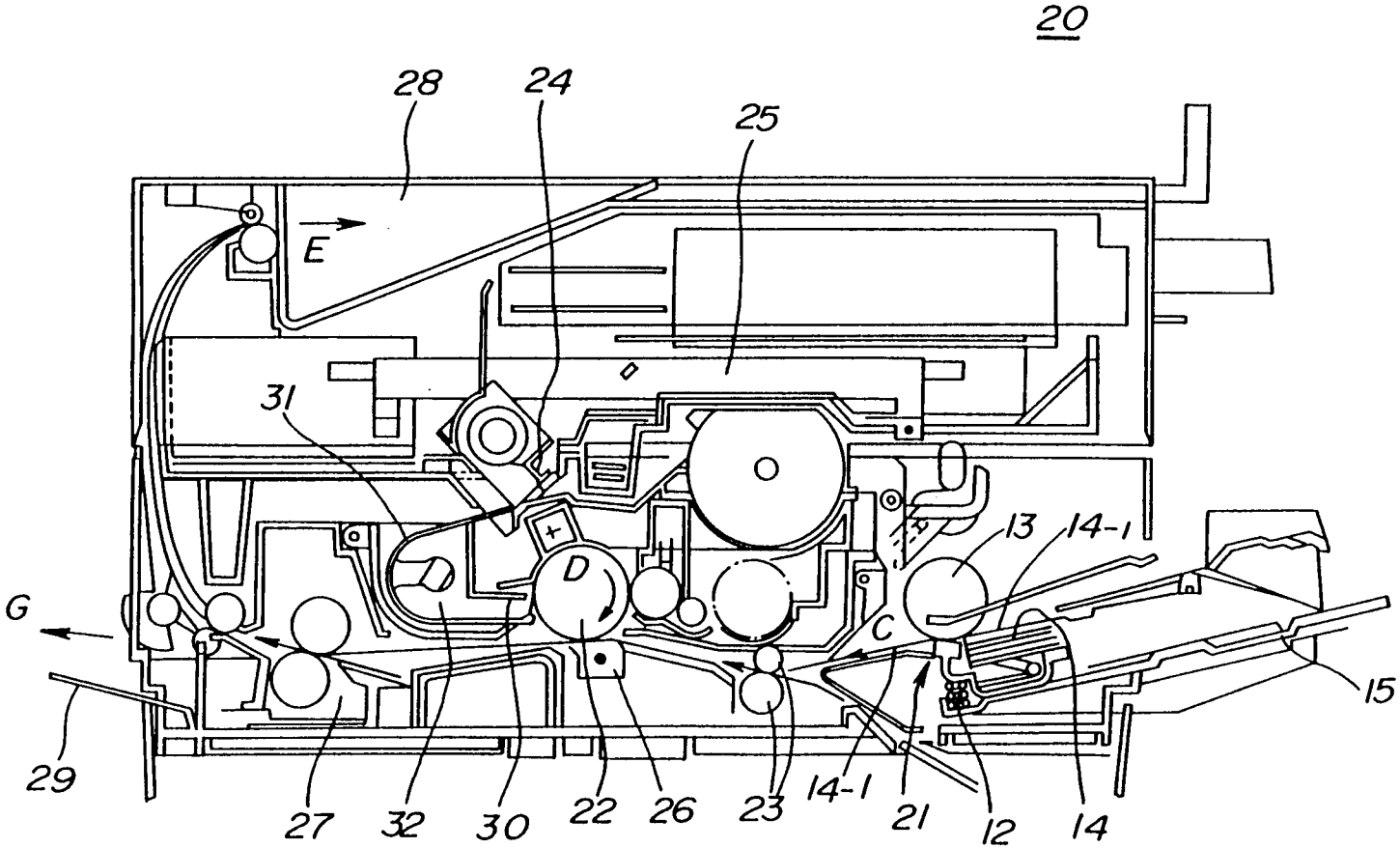
FIG. 5 is a cross sectional view generally showing a laser printer to which a first embodiment of the automatic cut-sheet feeding apparatus is applied.
Figure 6:
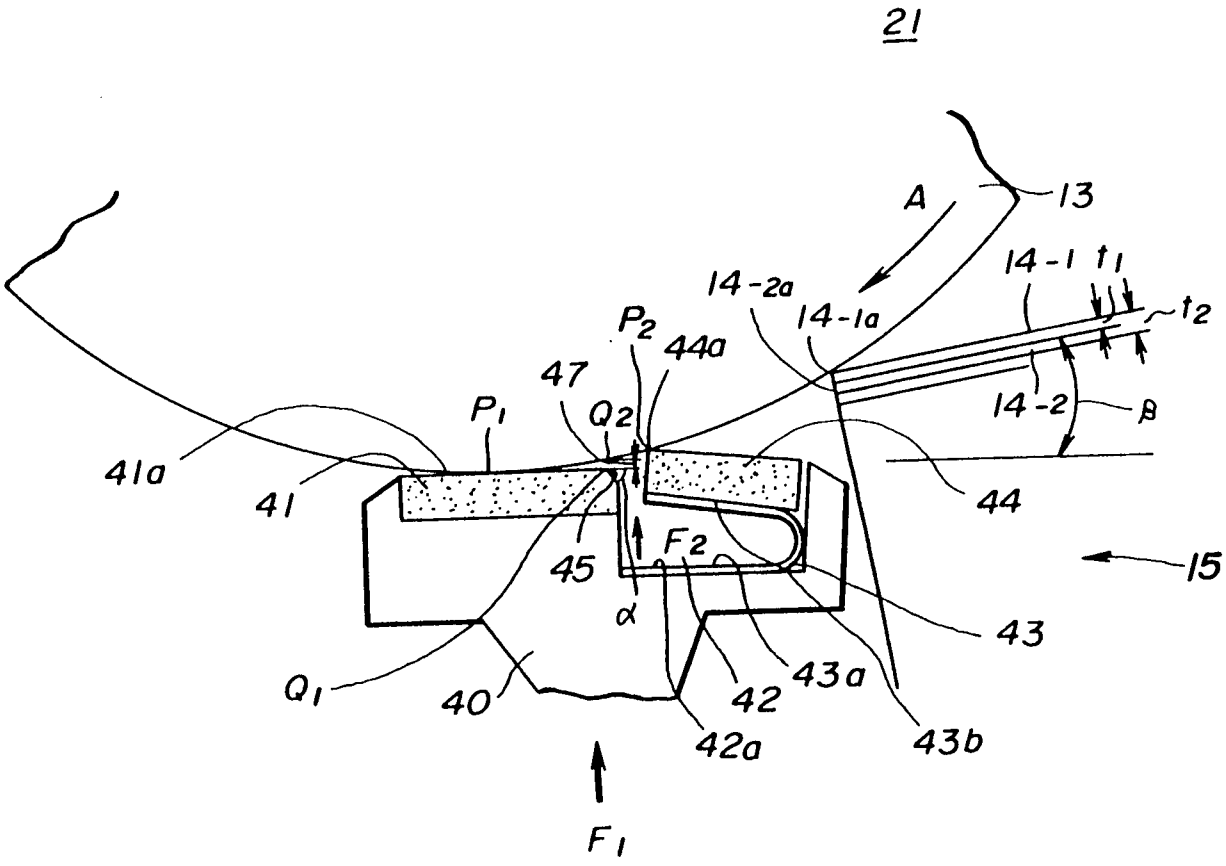
FIG. 6 is an enlarged view of an essential part of the automatic cut-sheet feeding apparatus shown in FIG. 5.

In FIGS. 5 and 6, parts corresponding to parts in FIG. 1 are designated by the same reference numerals.

FIG. 5 generally shows in cross section an internal section of a laser printer 20 to which a first embodiment of an automatic cut-sheet feeding apparatus 21 according to the present invention is applied.

The cut-sheet 14-1 is fed in and fed out by means of the automatic cut-sheet feeding apparatus 21 in a direction C as described hereinafter, and is transported to a photo sensitive drum 22 with a timing controlled by a pair of resist rollers 23.

On the other hand, the photosensitive drum 22 is rotated in a direction D by a main motor (not shown), and the surface of the photo sensitive drum 22 is charged by a charger 24. The charged surface of the photo sensitive drum 22 is scanned by a laser spot which is modulated in a write device 25 so as to form an electrostatic image on the surface of the photo sensitive drum 22. Then, toner is adhered on the surface of the photo sensitive drum 22 to visualize the electrostatic image as a toner image. A transfer charger 26 transfers the toner image onto the cut-sheet 14-1 which is transported by the resist rollers 23, and a fixing device 27 heats and fixes the image on the cut-sheet 14-1.

The cut-sheet 14-1 fed out of the fixing device 27 is either transported upwardly and ejected in a direction E onto a face-down ejecting tray 28 provided on an upper surface of the laser printer 20, or transported horizontally and ejected in a direction G onto a face-up ejecting tray 29.

The toner remaining on the surface of the photo sensitive drum 22 after the toner image is transferred onto the cut-sheet 14-1 is removed by a cleaning blade 30 of a cleaning unit 31, and the removed toner is collected and recovered into a toner recovering tank 32.

Next, a description will be given of the automatic cut-sheet feeding apparatus 31, in reference to FIG. 6.

FIG. 6 shows an enlarged view of an essential part of the apparatus 21.

A holder 40 is provided inside the cassette 15, and has a first pad piece 41 fixed to a top surface of the holder 40.

A groove 43 is formed on the top of the holder 40. A U-shaped leaf spring 43 is so provided on the groove 42 that one arm 43*a* thereof is fixed to the bottom 42*a* of the groove and the other arm 43*b* is free to undergo deformation resiliently.

On the other arm 43*b*, a second pad piece 44 is mounted.

The second pad piece 44 is disposed at a position preceding the first pad piece 41 with respect to the direction of the feeding of the cut-sheet 14-1, and is inclined so that the end near the first pad piece 41 is shifted upward. Also, the second pad piece 44 has a rectangular cross section, and thereby has an edge 44*a* at an uppermost position above a surface 41*a* of the first pad piece 41.

A stop surface 45 is formed at corner between a side face of the groove 42 and the surface 41*a* of the first pad piece 41, and has 45 degree angle $\alpha$ with respect to the surface 41*a* of the first pad piece 41.

When the cassette 15 has been loaded into the laser printer 20, the holder 40 is pressed against the feed roller 13 at the bottom part thereof and part near the leading edge 14-1*a* of the uppermost cut-sheet 14-1 of the stacked cut-sheets 14 inside the cassette 15 is also pressed against the feed roller 13, as indicated in FIG. 6.

The coil spring 12 is compressed to generate a spring force F1, which causes the first pad piece 41 to press against the peripheral surface of the feed roller 13 at a point P1. The surface 41*a* of the first pad piece 41 is substantially horizonal.

Figure 7:
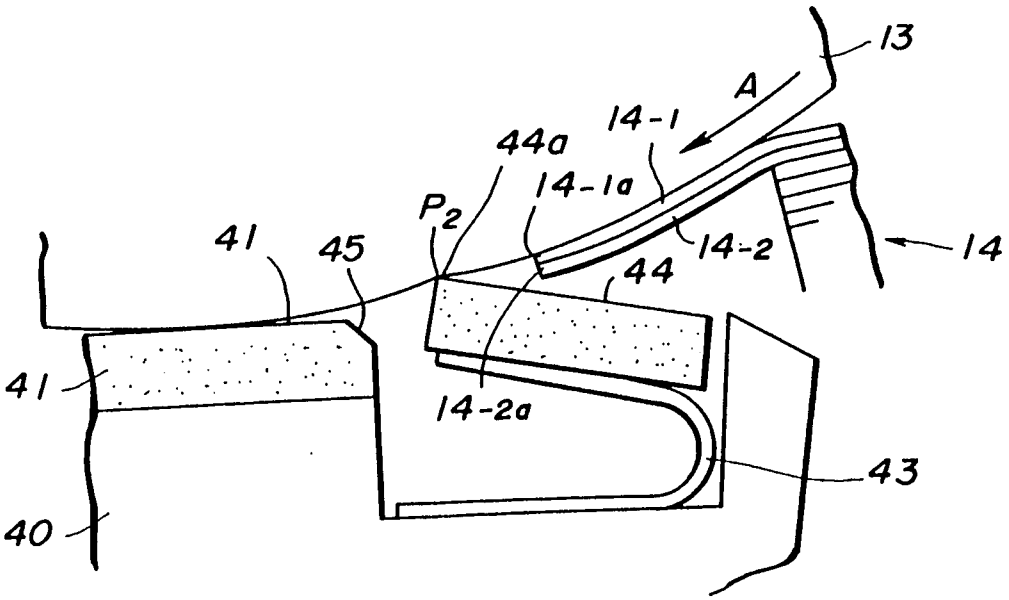
FIGS. 7 through 10 are schematic views showing the operation of feeding cut-sheets in the apparatus shown in FIG. 6.

The leaf spring 54 is also deformed to generate a spring force F2, which causes the edge 44*a* of the second pad piece 44 to press against the feed roller 13 at a point P2 so that the rubber surface of the feed roller 13 is depressed a little as clearly indicated in FIG. 7.

The spring force F1 is set at around 200 gr, and the spring force F2 is set at around 100 gr, that is, about one-half the spring force F1.

An entrance gap 47 is formed between a point Q1 at the corner between the surface 41*a* of the first pad piece 41 and the stop surface 45, and a point Q2 on the peripheral surface of the feed roller 13 confronting the point Q1. This entrance gap 47 has a dimension which is about 130 through 150% of the thickness t1 of the single cut-sheet 14-1, that is greater than the thickness t1 of the single cut-sheet 14-1 and is less than the thickness t2 of two-stacked cut-sheets 14-1 and 14-2.

Referring back to FIG. 5, the cassette 15 has been set at on angle nearly horizontal, and the angle $\beta$ (FIG. 6) between the surface 41*a* of the first pad piece 41 and the surface of the stack of cut-sheets 14 is around 10 degrees.

Next, a description will be given of operation of the automatic cut-sheet feeding apparatus 21 having the construction described heretofore.

Here, it is assumed that, when the feed roller 13 rotates in the direction A, the cut-sheet 14-2 just below the uppermost paper 14-1 is fed out together with the uppermost paper 14-1 from the cassette 15, as indicated in FIG. 7.

Figure 8:
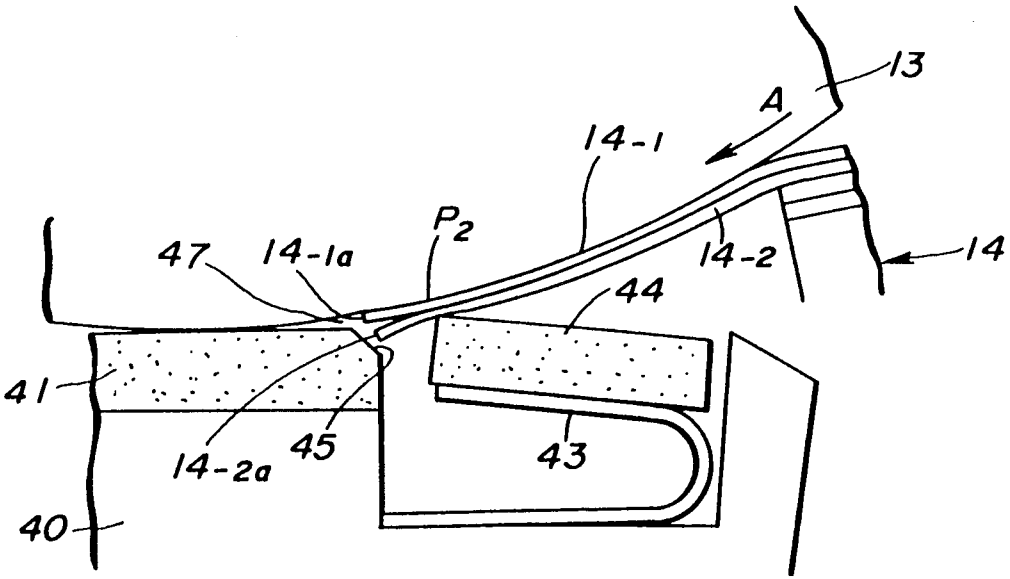

The leading edges of the two stacked cut-sheets 14-1 and 14-2 push the second pad piece 44 aside and advance together upon the rotation of the feed roller 13, as indicated in FIG. 8.

The second pad piece 44 is pushed aside as a result of the resilient deformation of the U-shaped leaf spring 43. Since the spring force F1 is two times the spring force F2, the holder 40 is not pushed aside, and the dimension of the entrance gap 47 is thereby not changed.

After the leading edges 14-1*a* and 14-2*a* of the cut-sheets 14-1 and 14-2 pass the point P2, the cut-sheet 14-2 is depressed a little at the point P2 by the edge 44*a* of the second pad piece 44, and thus the leading edge side of the cut-paper 14-2 is thereby curved downward a little, as indicated in FIG. 8.

Then, the leading edge 14-2*a* of the cut-sheet 14-2 abouts against the stop surface 45, as indicated in FIG. 8, and thus further advance of the cut-sheet 14-2 which should not be fed together with the cut-sheet 14-1 is positively restricted.

Since the dimension of the entrance gap 47 is maintained, the leading edge 14-2*a* of the cut-sheet 14-2 does not enter the gap 47 but abuts against the stop surface 45.

Accordingly, the excessive cut-sheet 14-2, which should not be fed out, together with the cut-sheet 14-1 which is normally fed out, is positively engaged and restricted from advancing further.

Figure 9:
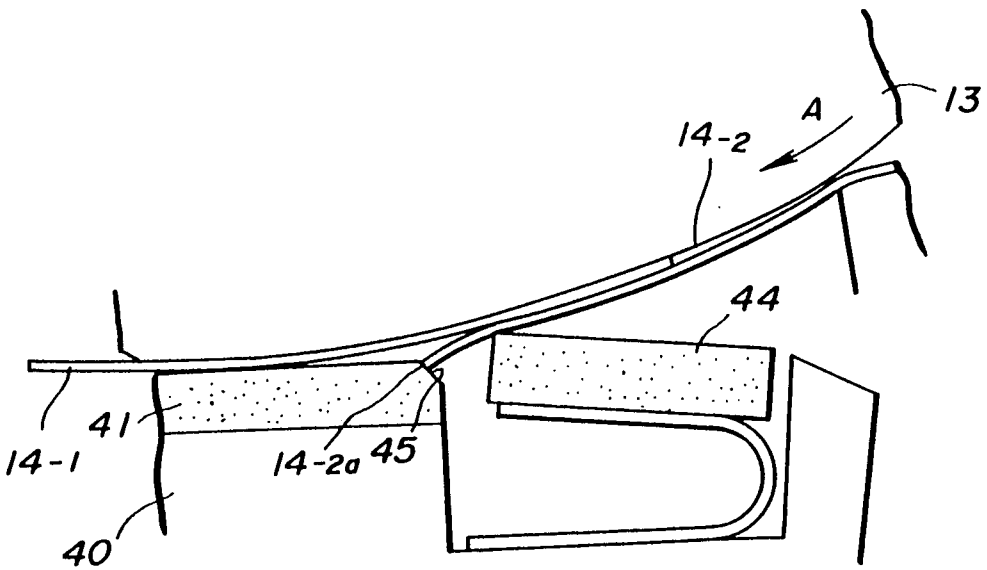

The cut-sheet 14-1 enters into the entrance gap 47 and passes between the feed roller 13 and the first pad piece 41, and is thereby fed out from the cassette 15 (FIG. 5), as indicated in FIG. 9.

Figure 10:
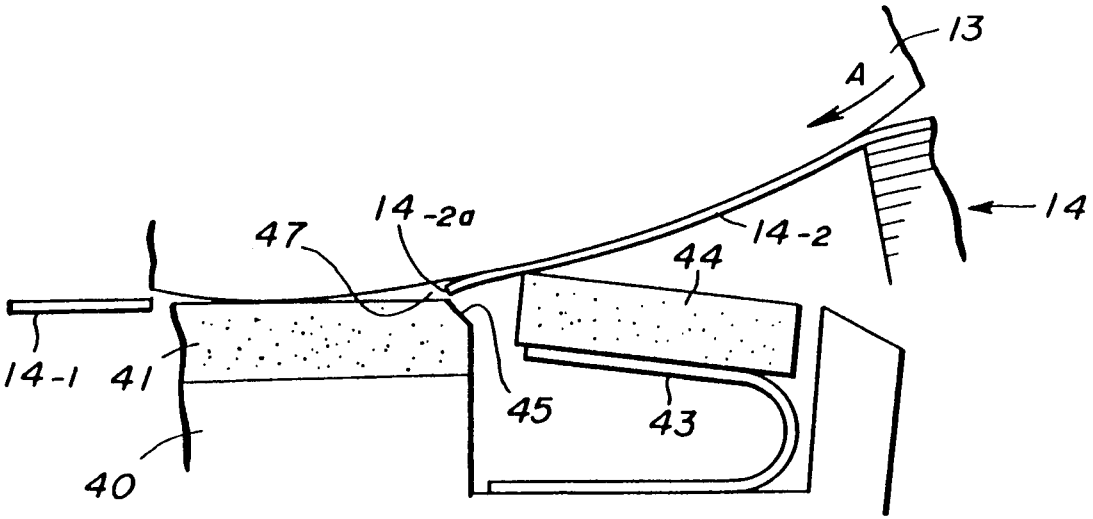

Whereupon the cut-sheet 14-1 is completely fed out, the stopped cut-sheet 14-2 is shifted upward a little to be pressed against the feed roller 13 at the point P2 by means of the second pad piece 44, and the leading edge 14-2*a* is moved to be offset from the stop surface 45 thereby to confront the entrance gap 47, as indicated in FIG. 10.

Therefore, following the cut-sheet 14-1, the cut-sheet 14-2 is fed out form the cassette 15.

Referring back to FIG. 9, the friction force which develops between the second pad piece 44 and the cut-sheet 14-2 also stops the further advancement of the cut-sheet 14-2.

If more than three cut-sheets are fed in a stacked manner, the excessive cut-sheets which should not be fed together with upper most paper which is normally fed are positively restricted from advancing, as in the same manner described heretofore.

Furthermore, since the angle $\eta$ (FIG. 6) is small (about 10 degrees), the advance of the cut-sheet from the cassette 15 is performed in a smooth manner, and thus prevention of cut-sheet jamming is ensured.

Figure 11:
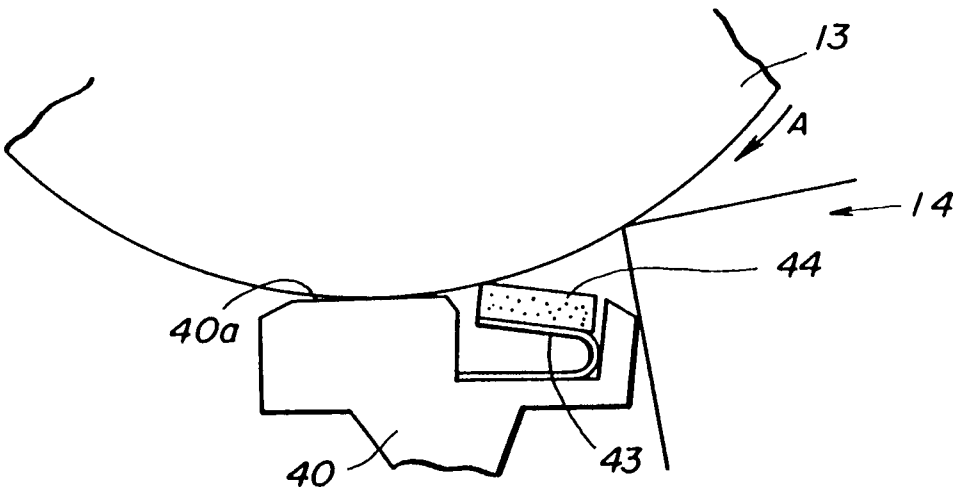
FIGS. 11 through 13 are side views respectively showing an essential part of the second, third and fourth embodiments of the automatic cut-sheet feeding apparatus according to the present invention.
Figure 12:
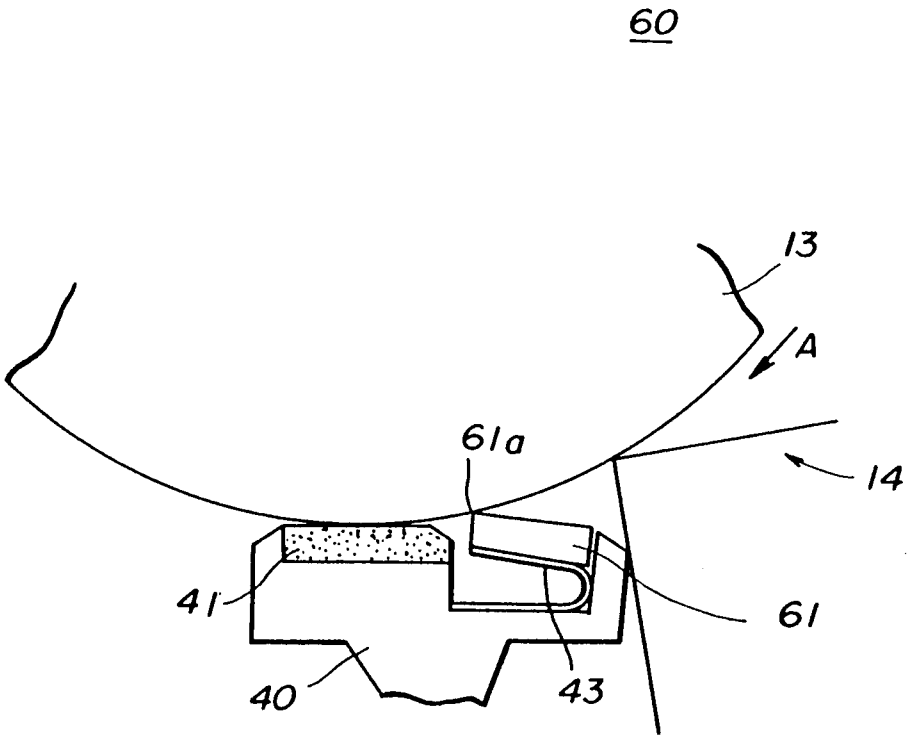
Figure 13:
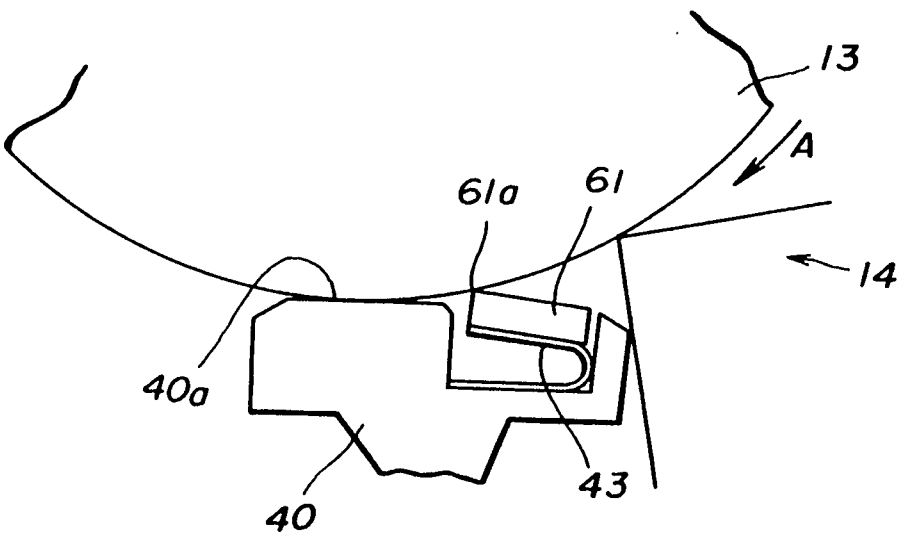

FIGS. 11 through 13 respectively show the automatic cut-sheet feeding apparatus according to the present invention. In FIGS. 11 through 13, parts which correspond to parts in FIG. 6 are designated by the same reference numerals.

In an automatic cut-sheet feeding apparatus 50 shows in FIG. 11, the first pad piece 41 in the apparatus 20 shown in FIG. 6 is omitted, and the top surface 40*a* of the holder 40 made of stainless steel is pressed into contact with the feed roller 13.

In an automatic cut-sheet feeding apparatus 60, shown in 12, a metal piece 61 made of stainless steel is mounted on the U-shaped leaf spring 43 in place of the second pad piece 44 in FIG. 6.

In this apparatus 60, the braking effect by the metal piece 61 is less than that in the previously described apparatuses, but the function of curving the cut-sheet by means of an edge 61*a* together with rubber peripheral surface of the feed roller 13 is greater than that in the previously describe apparatus.

An automatic cut-paper feeding automatic apparatus 70 shown in FIG. 13 is of a construction wherein the metal piece 61 is mounted on the U-shaped leaf spring 43 and the top surface 40*a* of the holder 40 is pressed into contact with the feed roller 13.

Further, the present invention is not limited to these embodiments, but various variations and modifications may be made without departing from the scope of the present invention.

What is claimed is:

1. An automatic cut-sheet feeding apparatus having a feed roller with which an uppermost cut-sheet of a stack of cut-sheets is brought into contact and which rotates in a direction so as to feed in and feed out the uppermost cut-sheet, and means for stopping the feeding of excessive cut-sheets which should not be fed out together with the uppermost cut-sheet when a plurality of cut-sheets are fed in together by said feed roller, and thereby automatically feeding out only the uppermost cut-sheet of the stack of cut-sheets one by one, said stopping means comprising:

a holder disposed to confront and contact said feed roller, said holder having a groove at a position preceding the position where said holder comes into contact with said feed roller along a direction in which said cut-sheet is transported;

a first spring member for pressing said holder against said feed roller at a first force;

a second spring member provided inside said groove of said holder and having a free end;

a push-piece supported on the free end of said second spring member, said push-piece being disposed at a position preceding the position where said holder makes contact with said feed roller along the direction in which said cut-sheet is transported, and being pressed against said feed roller by means of said second spring member at a second force which is less than said first force, said push-piece causing excessive cut-sheets to curve downwards when a plurality of cut-sheets have passed between said feed roller and said push-piece, and a stop surface disposed to confront a leading edge of said curved excessive cut-sheets and engage said leading edge of said curved excessive cut-sheets.

2. An automatic cut-sheet feeding apparatus as claimed in claim 1, in which said push-piece has a shape having an edge, and is pressed, at said edge thereof, against said feed roller.

3. An automatic cut-sheet feeding apparatus as claimed in claim 1, in which said push-piece is made of a pad material.

4. An automatic cut-sheet feeding apparatus as claimed in claim 1, in which said push-piece is made of metal.

5. An automatic cut-sheet feeding apparatus a claimed in claim 1, in which said stop surface has a surface which inclines downward with respect to a top surface of said holder.

6. An automatic cut-sheet feeding apparatus as claimed in claim 1, in which said stop surface has a surface which inclines downwards by an inclination angle of 45 degrees with respect to the top surface of said holder.

7. An automatic cut-sheet feeding apparatus as claimed in claim 1, in which said holder is a type having no pad, and the top metal surface of said holder is brought into contact with the feed roller.

8. An automatic cut-sheet feeding apparatus as claimed in claim 1, in which said second spring member is a U-shaped leaf spring which is provided inside said groove so that one free arm thereof projects to extend in an inclined state, and said push-piece is mounted on said one free arm.

9. An automatic cut-sheet feeding apparatus as claimed in claim 1, further having an entrance gap between the upper end of the stop surface and a point just above stop surface on a peripheral surface of said feed roller, and entrance gap having dimension greater than a thickness of a single cut-sheet and less than a thickness of two cut-sheets lying one upon the other.

* * * * *